United States Patent [19]

Bloomfield

[11] 3,966,419

[45] June 29, 1976

[54] CATALYTIC CONVERTER HAVING MONOLITH WITH MICA SUPPORT MEANS THEREFOR

[75] Inventor: Rodger E. Bloomfield, Linden, Mich.

[73] Assignee: General Motors Corporation, Detroit, Mich.

[22] Filed: Nov. 18, 1974

[21] Appl. No.: 524,486

[52] U.S. Cl. ..... 23/288 F; 23/288 FC; 60/322

[51] Int. Cl.[2] ..... B01J 8/00; F01N 3/15; F01N 7/00

[58] Field of Search ..... 23/288 F, 288 FC; 60/322; 285/DIG. 6, 187; 138/108, 112

[56] References Cited

UNITED STATES PATENTS

| | | | |
|---|---|---|---|
| 3,692,497 | 9/1972 | Keith et al. | 23/288 FC |
| 3,823,555 | 7/1974 | Cole | 23/288 FA |
| 3,824,788 | 7/1974 | Cole et al. | 23/288 FA |
| 3,852,042 | 12/1974 | Wagner | 23/288 FC |
| 3,854,888 | 12/1974 | Frietzsche et al. | 23/288 FC |

OTHER PUBLICATIONS

Kirk–Othmer; "Encyclopedia of Chem. Tech.," 1967; pp. 398, 399, 400, 415.

Osborne; "An Encyclopedia of the Iron and Steel Industry;" 1968; Appendix III(*a*); Tech. Press Ltd.

*Primary Examiner*—Morris O. Wolk
*Assistant Examiner*—Bradley R. Garris
*Attorney, Agent, or Firm*—C. K. Veenstra

[57] ABSTRACT

Spacers formed from mica are disposed in a catalytic converter between a monolithic ceramic catalyst element and a metal converter housing. As the converter warms, the spacers increase the compressive loading on the catalyst element to support and immobilize it within the housing.

7 Claims, 6 Drawing Figures

CATALYTIC CONVERTER HAVING MONOLITH WITH MICA SUPPORT MEANS THEREFOR

This invention relates to a catalytic converter for internal combustion engine exhaust gases and more particularly, to such a converter having mica spacers supporting and immobilizing a monolithic ceramic catalyst element inside a metal converter housing.

Catalytic converters have been proposed to promote oxidation of carbon monoxide and unburned hydrocarbons and/or reduction of oxides of nitrogen in internal combustion engine exhaust gases. As a general rule, the catalyst and the converter housing must be designed to operate at the elevated temperatures of the exhaust gases. For this and other reasons, stainless steels are often used for the converter housing.

In some applications, monolithic ceramic substrates formed of alumina are used as catalysts or as substances for catalytic materials. These ceramic catalyst elements have a rate of linear thermal expansion lower than that of their metal housings. In the usual assembly procedure the ceramic catalyst element is clamped by and thus supported and immobilized within the metal housing at room temperature. However, as the assembly is subsequently heated by the exhaust gases, the metal housing thermally expands axially and diametrically much faster than the ceramic catalyst element. If not properly supported, the ceramic catalyst element would become loose within the housing and be fractured.

Some such converters have a resilient flexible knitted wire mesh wrapped around the catalyst element to provide radial support. However, such a construction is costly and requires extensive development to assure that the mesh does not lose its resiliency during operation.

This invention provides a catalytic converter having another means for securely supporting and immobilizing a monolithic ceramic catalyst element within a metal housing throughout the range of temperatures to which it may be subjected.

In a catalytic converter provided by this invention, one or more thermally responsive spacers are disposed between a monolithic ceramic catalyst element and a metal housing. The spacer is formed of mica having a higher rate of linear thermal expansion than that of either the metal housing or the ceramic catalyst element. As the converter is warmed, the spacer tends to expand faster than either the housing or the catalyst element thereby increasing the compressive loading on the catalyst element and thus ensuring that it is properly supported and immobilized within the housing.

It has been found that certain types of mica, such as phlogopite, expand 300 percent when warmed from room temperature (530°R) to about 1570°R with the rate of expansion being at least 19 percent per 100°R. This thermal expansion rate is substantially greater than those for stainless steel (about one-eighth percent per 100°R) and alumina (about one-sixteenth percent per 100°R) over that same temperature range.

Thus in a catalytic converter provided by this invention, one or more phlogopite mica spacers perhaps one-quarter inch thick at room temperature are used to support and immobilize a cylindrical monolithic alumina catalyst element about 5 inches in diameter and 6 inches in length disposed within a conforming stainless steel housing. During operation, the spacer expands to compensate for the difference between the expansion of the housing and the expansion of the catalyst element and also increases the compressive loading on the catalyst element, thus supporting and immobilizing the element within the housing.

Moreover, when phlogopite is cooled to room temperature after initial heating to about 2060°R, it does not contract completely to its original room temperature dimensions. Thus in a catalytic converter having a phlogopite mica spacer, the spacer provides residual expansion forces which support and immobilize the catalyst element throughout the range of temperatures to which it may be subjected.

In another form, many layers of large flakes of muscovite mica are bonded together and constrained in a compressed state with an organic, silicone base, binder at high temperature (1720°R) and pressure (1000 psi) to form what is known as heater plate material. As one example, a stack of approximately 60 layers or splittings of muscovite mica, each about 0.0055 inch thick, can be bonded and compressed to form a heater plate about one-quarter inch thick. This material expands 253 percent when heated from room temperature to about 1770°R with the rate of expansion being at least 3 percent per 100°R. If maintained at that temperature for approximately one hour, the binder decomposes, releasing the mica layers from their compressed state. This material then tends to assume the free or unbonded height (about 0.33 inch) of the stacked layers.

In another catalytic converter provided by this invention, one or more spacers of such mica heater plate material are disposed between a monolithic catalyst element and a surrounding metal housing. This assembly is then heated to a temperature of 1770°R for one hour to release the mica layers. However, the layers are unable to assume their free height and instead provide residual expansion forces which support and immobilize the catalyst element throughout the range of temperatures to which it may be subjected.

The details as well as other features and advantages of this invention are set forth in the remainder of the specification and in the accompanying drawings wherein.

Figure 1:
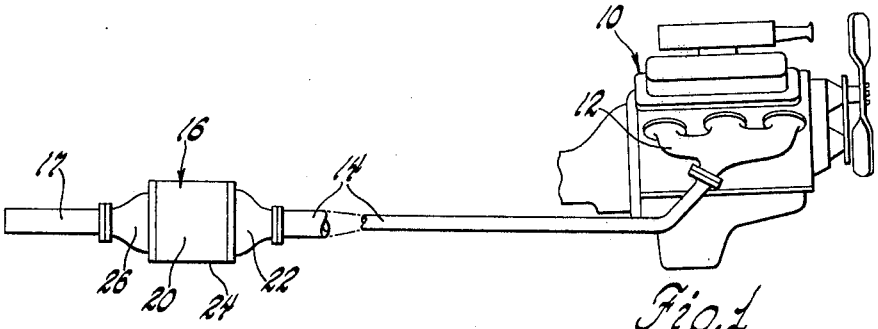
FIG. 1 shows an internal combustion engine having a catalytic converter provided by this invention.

Referring first to FIG. 1, an internal combustion engine 10 has an exhaust manifold 12 discharging exhaust gases through an exhaust pipe 14, a catalytic converter 16, and a tail pipe 17.

Figure 2:
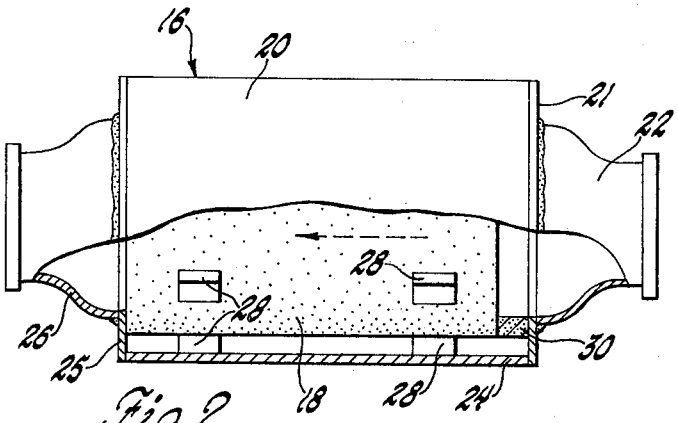
FIG. 2 is an enlarged view of the catalytic converter of FIG. 1 with part of the metal housing broken away to show a monolithic catalyst element supported and immobilized by a plurality of mica spacers.

As shown in FIG. 2, converter 16 has a monolithic catalyst element 18 disposed within a stainless steel housing 20. Housing 20 includes an end wall 21 having an inlet fitting 22 receiving the exhaust gases from exhaust pipe 14, a shell 24 surrounding catalyst element 18, and an end wall 25 having an outlet fitting 26 discharging the exhaust gases to tail pipe 17.

Catalyst element 18 is extruded from a ceramic refractory material, such as aluminum oxide, in any of the well known manners to provide a monolithic element having a honeycombed structure comprising straight passages extending axially along its length. It is coated with catalytic materials, such as platinum and palladium, effective to promote oxidation of carbon monoxide and unburned hydrocarbons and/or reduction of oxides of nitrogen.

A plurality of mica spacer elements 28, or one or more rings of mica, are disposed circumferentially about catalyst element 18 and within shell 24. A mica spacer ring or gasket 30, or a plurality of mica spacer elements, is disposed axially between the end of catalyst element 18 and end wall 21. If desired, another mica spacer ring or gasket may be disposed axially between the other end of catalyst element 18 and end wall 25.

The stainless steel housing 20 exhibits a rate of linear thermal expansion of about one-eighth percent per 100°R, while the ceramic catalyst element 18 exhibits a rate of linear thermal expansion of perhaps one-sixteenth percent per 100°R. This difference in expansion rates causes housing 20 to expand substantially faster than element 18 and would lead to loosening of catalyst element 18 within housing 20 if uncompensated.

However, mica spacers 28 and 30 provide the required compensation. They have a rate of linear thermal expansion substantially in excess of that for either stainless steel housing 20 or ceramic catalyst element 18 and thus tend to expand much faster than both housing 20 and element 18. Accordingly, mica spacers 28 and 30 expand to compensate for the difference between the expansion of housing 20 and the expansion of catalyst element 18 and also increase the compressive loading on element 18. Spacers 28 thereby maintain radial supporting and immobilizing forces between shell 24 and element 18, and spacer 30 maintains axial supporting and immobilizing forces between element 18 and end walls 21 and 25. Catalyst element 18 is thus securely retained within housing 20.

Figure 3:
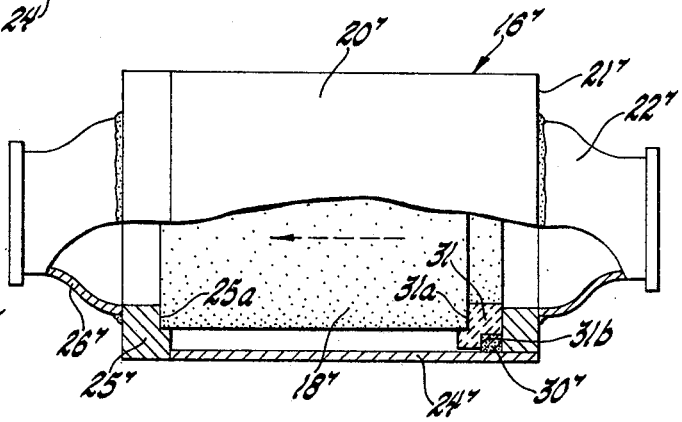
FIG. 3 is a view, similar to FIG. 2, of another catalytic converter provided by this invention in which the monolithic catalyst element is supported and immobilized by a single mica spacer.

The alternative embodiment 16' of the catalytic converter shown in FIG. 3 has a similar ceramic monolith catalyst element 18' disposed within a stainless steel housing 20'. Housing 20' includes an end wall 21' having an inlet fitting 22', a shell 24' surrounding catalyst element 18', and an end wall 25' having an outlet fitting 26'.

The left end of element 18' is received in an annular recess **25*a* formed in end wall 25' while the right end of element 18' is received in an annular recess 31*a* formed in an annular ceramic block 31. Block 31 also has an outer annular groove 31*b* receiving a mica ring 30'.**

Block 31 is made from a material similar or identical to that of catalyst element 18' and accordingly expands at the same rate as element 18'. However, mica ring 30' has a rate of linear thermal expansion higher than that of either housing 20' or ceramic element 18' and ceramic block 31 and thus tends to expand both radially and axially much faster than housing 20', ceramic element 18', and ceramic block 31. Mica ring 30' thus forces ceramic block 31 away from end wall 21' to maintain ceramic element 18' in axial compression between block 31 and end wall 25' while simultaneously forcing ceramic block 31 inwardly from shell 24' to maintain radial supporting and immobilizing forces on element 18'. Catalyst element 18' is thereby securely retained in housing 20'.

Figure 4:
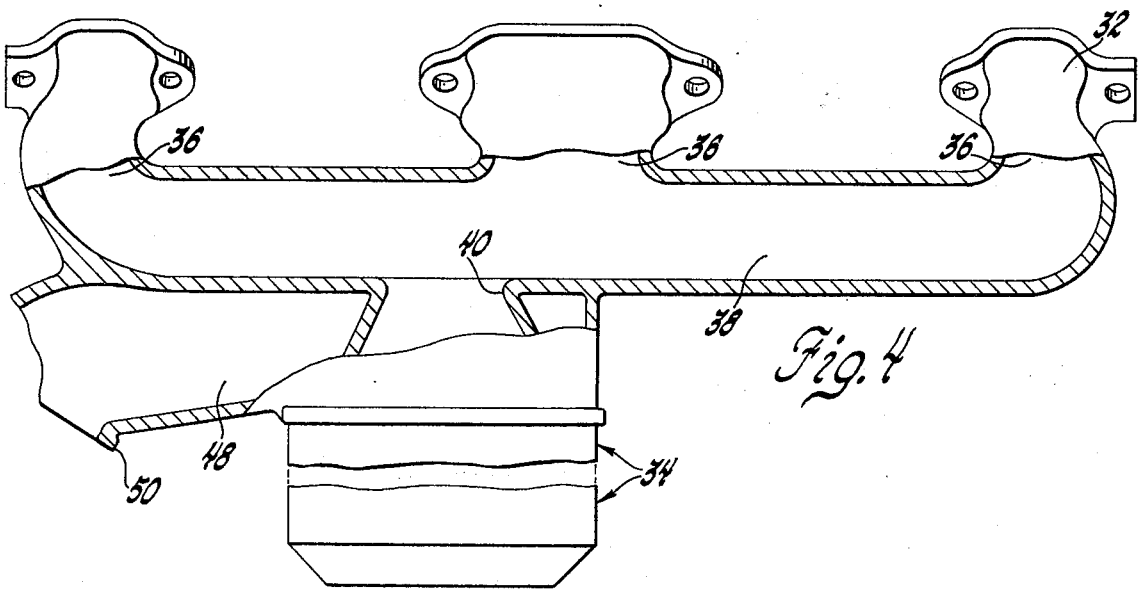
FIG. 4 is an enlarged side elevational view of an internal combustion engine exhaust manifold similar to that shown in FIG. 1 but modified to receive another catalytic converter provided by this invention, parts being broken away to show the basic construction of the exhaust manifold.
Figure 5:
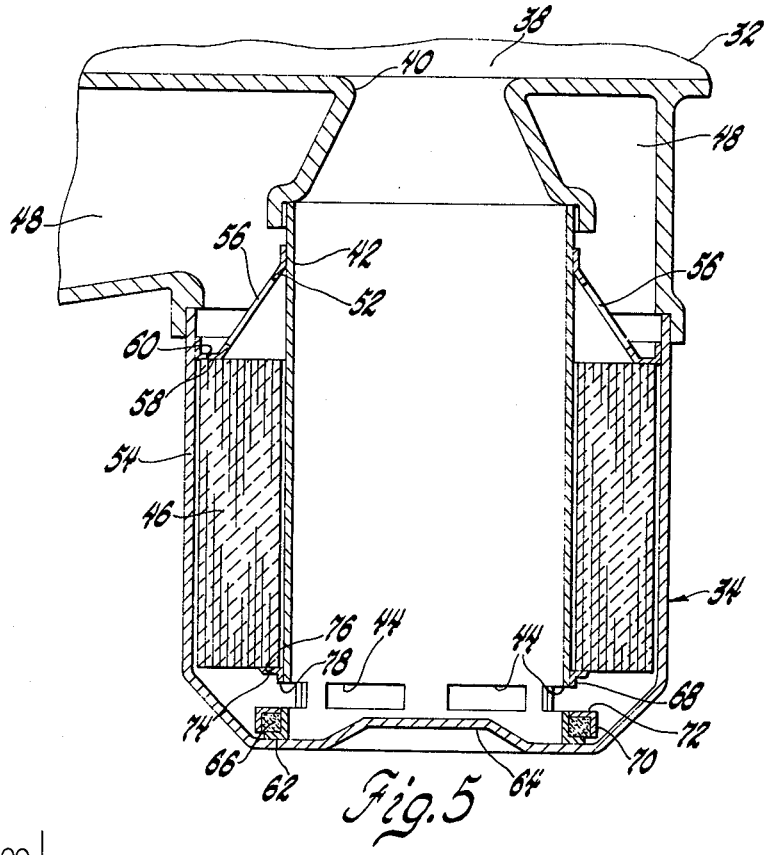
FIG. 5 is a sectional elevational view of the catalytic converter shown in FIG. 4, enlarged to show details of the converter.

Referring now to FIGS. 4 and 5, an exhaust manifold 32, similar to manifold 12 shown in FIG. 1, has been modified to directly receive another embodiment 34 of the catalytic converter provided by this invention.

Manifold 32 may be identical to that set forth in Ser. No. 500,330 filed Aug. 23, 1974, and many details have been omitted here for ease of illustration. Basically, manifold 32 comprises a plurality of legs 36 which lead from the engine combustion chambers to an exhaust plenum 38. Plenum 38 has a bottom opening 40 through which exhaust gases are delivered to the inner tube 42 of converter 34. The exhaust gases flow downwardly through tube 42, radially through windows 44 at the bottom of tube 42, upwardly through an annular monolithic catalyst element 46, and then into an annular plenum 48 from which they are discharged through an outlet fitting 50 to an exhaust pipe.

As shown in FIG. 5, an upper plate 52 extends from inner tube 42 out to a stainless steel shell 54. Plate 52 has a plurality of openings 56 which permit flow of exhaust gases into discharge plenum 48. An annular shoulder 58 formed in plate 52 receives the outer upper rim 60 of element 46.

The lower end of inner tube 42 has an annular flange 62 resting against the base 64 of shell 54. A ring 66 of mica surrounds tube 42 above flange 62. An annular extension 68 has a rim 70 surrounding ring 66, a flange 72 overlying ring 66, and a shoulder 74 which receives the inner lower rim 76 of element 46. Extension 68 has windows 78 aligned with windows 44 in inner tube 42 and may have tabs (not shown) extending into windows 44 to facilitate assembly.

Catalyst element 46 is extruded from a ceramic refractory composition, such as aluminum oxide, and coated with catalytic materials, such as platinum and palladium, to promote oxidation of unburned exhaust constituents and/or reduction of oxides of nitrogen. As exhaust gases warm converter 34 and react exothermically therein, ceramic catalyst element 46 thermally expands far less than the stainless steel housing formed by shell 54, inner tube 42, upper plate 52 and extension 68. If this difference in thermal expansions is not compensated, element 46 will become loose within shell 54 leading to mechanical deterioration of the catalyst element.

However, mica ring 66 forces extension 68 upwardly and maintains catalyst element 46 in compression between extension flange 76 and upper plate flange 60. As converter 34 warms, mica ring 66 expands axially at a faster rate than either ceramic element 46 or any of the stainless steel members forming the converter housing. The mica ring's high axial expansion rate ensures that catalyst element 46 is supported and immobilized within shell 54 throughout the range of temperatures to which converter 34 may be subjected. In this particular embodiment, it is contemplated that a knitted wire mesh may be wrapped about element 46 to provide radial support for element 46.

There are many types of mica which exhibit rates of linear thermal expansion greater than those for monolithic catalyst elements and metal converter housings.

Figure 6:
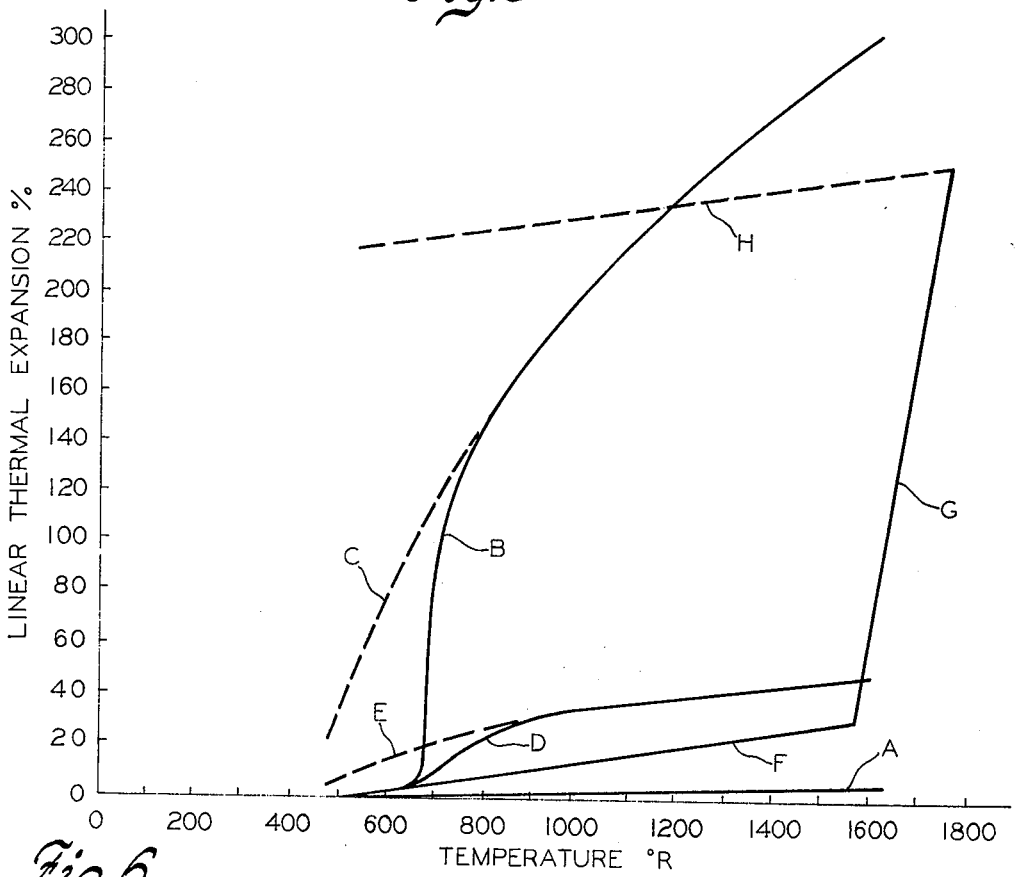
FIG. 6 is a plot showing the linear expansion (in percent) exhibited by various types of mica with variations in temperature (in degrees Rankine).

FIG. 6 compares the linear thermal expansion displayed by large flake muscovite mica formed into mica heater plate and by phlogopite mica with that displayed by stainless steel.

Referring to FIG. 6, it will be noted that the linear expansion of stainless steel, plotted as line A, is only about 2 percent over the operating range of a catalytic converter. On the other hand, the linear expansion of phlogopite mica, plotted as curve B, exceeds 300 percent over this same range. Moreover, after initial heating above about 2060°R, phlogopite does not contract along curve B but instead contracts along and subsequently follows the dashed curve C, thus having a residual expansion shown by the distance between curve B and dashed curve C.

It will be appreciated, of course, that mica spacers and rings 28, 30, 30' and 66 formed of phlogopite do not expand 300 percent within their converter housings. Instead the tendency for thermal expansion is converted into forces which support and immobilize the monolithic catalyst elements. The forces generated may be understood from curve D and dashed curve E which illustrate the initial and subsequent thermal expansion of phlogopite mica against a compression load of 30 psi.

The linear thermal expansion of large flake muscovite mica splittings, bonded with a silicone binder into mica heater plate, is plotted as lines F and G and dashed line H. Below about 1660°R the mica heater plate follows line F, expanding faster than the stainless steel and ceramic materials. Between about 1660°R and about 1770°R the binder decomposes, allowing the mica splittings to separate and assume their free height and thus causing the heater plate to expand along line G. After the binder is fully decomposed, the heater plate follows dashed line H, having a residual expansion shown by the distance between line F and dashed line H.

Again it will be appreciated that mica spacers 28, 30, 30' and 66 formed of such heater plate do not expand over 250 percent within their converter housings but that the tendency for thermal expansion is converted into forces which support and immobilize the monolithic catalyst elements.

To take advantage of the residual expansion forces created in mica spacers and rings 28, 30, 30' and 66, it is contemplated that converters 16, 16' and 34 will be subjected to an initial high temperature cycle as a part of the converter manufacturing process. The residual expansion forces thus created in the mica elements supplements the compressive loading which can be applied to the ceramic catalyst elements during assembly of the converters and assures that the catalyst elements are securely supported and immobilized.

However, even when it is desired to take advantage of the residual expansion forces, it is not essential that the converters be subjected to an initial high temperature cycle during the converter manufacturing process. It may be expected that the converters will be heated sufficiently during initial use to create the residual expansion forces in the mica elements.

The embodiments of the invention in which an exclusive property or privilege is claimed are defined as follows:

1. A catalytic converter comprising a housing, a monolithic catalyst element disposed within said housing, said catalyst element having a rate of thermal expansion less than said housing, and support means disposed between said catalyst element and said housing for providing supporting and immobilizing forces therebetween, said support means being formed of mica having a rate of thermal expansion greater than said housing to thereby provide increasing supporting and immobilizing forces between said catalyst element and said housing as the temperature of said converter increases.

2. A catalytic converter comprising a housing, a monolithic catalyst element disposed within said housing, said catalyst element having a rate of thermal expansion less than said housing, and support means disposed between said catalyst element and said housing for providing supporting and immobilizing forces therebetween, said support means being formed of mica having a rate of thermal expansion greater than said housing to thereby provide increasing supporting and immobilizing forces between said catalyst element and said housing as the temperature of said converter increases and further having the property of creating residual expansion forces after being initially heated above a certain temperature to thereby support and immobilize said catalyst element within said housing throughout the range of temperatures to which said converter is subjected.

3. A catalytic converter comprising a housing, a monolithic catalyst element disposed within said housing, said catalyst element having a rate of thermal expansion less than said housing, and support means disposed between said catalyst element and said housing for providing supporting and immobilizing forces therebetween, said support means being formed of phlogopite mica having a rate of thermal expansion greater than said housing to thereby provide increasing supporting and immoblizing forces between said catalyst element and said housing as the temperature of said converter increases and further having the property of creating residual expansion forces after being initially heated above a certain temperature to thereby support and immobilize said catalyst element within said housing throughout the range of temperatures to which said converter is subjected.

4. A catalytic converter comprising a housing, a monolithic catalyst element disposed within said housing, said catalyst element having a rate of thermal expansion less than said housing, and support means disposed between said catalyst element and said housing for providing supporting and immobilizing forces therebetween, said support means being formed of heater plate material comprising large flakes of muscovite mica bonded together with an organic binder and having a rate of thermal expansion greater than said housing to thereby provide increasing supporting and immobilizing forces between said catalyst element and said housing as the temperature of said converter increases and further having the property of creating residual expansion forces after being initially heated above a certain temperature to thereby support and immobilize said catalyst element within said housing throughout the range of temperatures to which said converter is subjected.

5. A catalytic converter comprising a cylindrical housing, a cylindrical monolithic catalyst element coaxially disposed within said housing, said catalyst element having a rate of thermal expansion less than said housing, and support means disposed circumferentially about said catalyst element within said housing for providing radial supporting and immobilizing forces therebetween, said support means being formed of mica having a rate of thermal expansion greater than said housing to thereby provide increasing supporting and immobilizing forces between said catalyst element and said housing as the temperature of said converter increases.

6. A catalytic converter comprising a housing including end members, a monolithic catalyst element disposed within said housing between said end members, said catalyst element having a rate of thermal expansion less than said housing, and support means disposed at one end of said catalyst element between said catalyst element and the adjacent end member of said housing for providing supporting and immobilizing forces therebetween, said support means being formed of mica having a rate of thermal expansion greater than said housing to thereby provide increasing supporting and immobilizing forces between said catalyst element and said end members as the temperature of said converter increases.

7. A catalytic converter comprising a housing including end members and a cylindrical shell, a cylindrical monolithic catalyst element disposed between said end members and within said shell, said catalyst element having a rate of thermal expansion less than said housing, said catalyst element including means defining an annular groove opening axially toward one of said end members and radially toward said shell, and a ring disposed in said groove for providing radial supporting and immbolizing forces between said catalyst element and said shell and axial supporting and immobilizing forces between said catalyst element and said end members, said ring being formed of mica having a rate of thermal expansion greater than said housing to thereby provide increasing supporting and immobilizing forces between said catalyst element and said housing as the temperature of said converter increases and further having the property of creating residual expansion forces after being initially heated above a certain temperature to thereby support and immobilize said catalyst element within said housing throughout the range of temperatures to which said converter is subjected.

* * * * *

REEXAMINATION CERTIFICATE (429th)

United States Patent [19]

Bloomfield

[11] B1 3,966,419

[45] Certificate Issued Dec. 10, 1985

[54] CATALYTIC CONVERTER HAVING MONOLITH WITH MICA SUPPORT MEANS THEREFOR

[75] Inventor: Rodger E. Bloomfield, Linden, Mich.

[73] Assignee: General Motors Corporation, Detroit, Mich.

Reexamination Request:
No. 90/000,726, Feb. 25, 1985

Reexamination Certificate for:

| | |
|---|---|
| Patent No.: | **3,966,419** |
| Issued: | **Jun. 29, 1976** |
| Appl. No.: | **524,486** |
| Filed: | **Nov. 18, 1974** |

[51] Int. Cl.[4] ..... F01N 3/28; F01N 7/16

[52] U.S. Cl. ..... 422/179; 60/322

[56] References Cited

U.S. PATENT DOCUMENTS

| | | | |
|---|---|---|---|
| 3,441,381 | 4/1969 | Keith et al. | 23/288 |
| 3,692,497 | 9/1972 | Keith et al. | 23/288 R |
| 3,841,842 | 10/1974 | Wiley | 23/288 F |
| 3,852,042 | 12/1974 | Wagner | 23/288 F |
| 3,854,888 | 12/1974 | Frietzsche et al. | 23/288 F |
| 3,916,057 | 10/1975 | Hatch et al. | 428/236 |
| 3,966,419 | 6/1976 | Bloomfield | 23/288 F |

OTHER PUBLICATIONS

Kirk-Othmer; "Encyclopedia of Chemical Technology"; Second Edition; vol. 13; pp. 398, 399, 400 and 415.

*Primary Examiner*—David L. Lacey

[57] ABSTRACT

Spacers formed from mica are disposed in a catalytic converter between a monolithic ceramic catalyst element and a metal converter housing. As the converter warms, the spacers increase the compressive loading on the catalyst element to support and immobilize it within the housing.

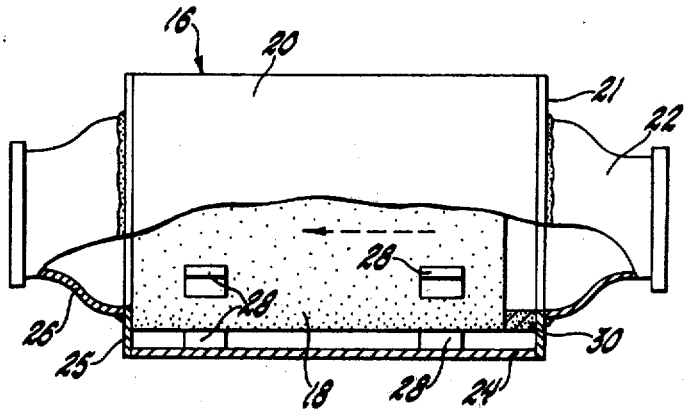

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–7 is confirmed.

* * * * *

REEXAMINATION CERTIFICATE (809th)

United States Patent [19]

Bloomfield

[11] B2 3,966,419

[45] Certificate Issued Jan. 12, 1988

[54] CATALYTIC CONVERTER HAVING MONOLITH WITH MICA SUPPORT MEANS THEREFOR

[75] Inventor: Rodger E. Bloomfield, Linden, Mich.

[73] Assignee: General Motors Corporation, Detroit, Mich.

Reexamination Request
No. 90/001,160, Feb. 5, 1987
No. 90/001,198, Mar. 23, 1987

Reexamination Certificate for:
Patent No.: 3,966,419
Issued: Jun. 29, 1976
Appl. No.: 524,486
Filed: Nov. 18, 1974

Reexamination Certificate B1 3,966,419 issued Dec. 10, 1985.

[51] Int. Cl.[4] ..... B01J 8/00; F01N 3/28
[52] U.S. Cl. ..... 422/179; 60/322; 248/DIG. 1

[56] References Cited

U.S. PATENT DOCUMENTS

| | | | |
|---|---|---|---|
| 1,811,762 | 6/1931 | Schnell . | |
| 1,912,544 | 6/1933 | Slidell . | |
| 3,090,676 | 5/1963 | Johnson | 23/288 |
| 3,094,394 | 6/1963 | Innes et al. | 23/288 |
| 3,109,715 | 11/1963 | Johnson et al. | 23/288 |
| 3,146,073 | 8/1964 | Johnson | 23/288 |
| 3,189,418 | 6/1965 | Gary | 23/288 |
| 3,197,287 | 7/1965 | Innes et al. | 23/288 |
| 3,441,381 | 4/1969 | Keith et al. | 23/288 |
| 3,441,382 | 4/1969 | Keith et al. | 23/288 |
| 3,771,967 | 11/1973 | Nowak | 23/288 F |
| 3,775,064 | 11/1973 | Berger et al. | 23/288 |
| 3,854,888 | 12/1974 | Frietzsche et al. | 23/288 F |
| 3,959,865 | 6/1976 | Close et al. | 29/157 R |

OTHER PUBLICATIONS

General Motors Corporation v. Toyota Motor Co., Ltd. 569 F. supp. 889, 899 (1983); Court's Findings of Fact A.1–4 with record pages cited.

Newspaper materials on Catalytic Converter demand, circa 1960; GM exhibit 141, GM v. Toyota.

Nebel et al; Automobile Exhaust Gas Treatment–An Industry Report; SAE paper #173; Aug. 12–16, 1957; pp. 6–7, inter alia.

Nebel et al; Catalytic Oxidation of Automobile Exhaust Gases–an Evaluation of the Houdry Catalyst; Jan. 12–16, 1959; SAE paper 29R; pp. 17–20, inter alia.

Van Derveer et al; The Development of Catalytic Converter for the Oxidation of Exhaust Hydrocarbons; Jan. 12–16, 1959; SAE paper 29S; pp. 3, 14, inter alia.

Davis et al; Catalytic Converter Development Problems; Mar. 12–16, 1962; SAE paper 486F; pp. 1, 3 (FIG. 4), and 8, inter alia.

Davis et al; The Co-operative Evaluation of the General Motors Catalytic Converter System; AMA Engineering notes 632; Feb. 1963; pp. 4, 5, inter alia.

Jones et al; Comments on SAE paper No. 690503, Performance of a Catalytic Converter on Non-Leaded Fuel; May 22, 1969; FIG. 3, inter alia.

Toyota Motor Co., Ltd; Application for Suspension of 1975 Motor Vehicle Exhaust Emissions Standards; Jun., 1973; selected pp. 1–3, 13, 14, and 27–8; GM exhibit No. 4, GM v. Toyota.

Weaver et al; Ford 450 Car Catalyst Field Test; Oct. 21–25, 1974; SAE paper 741061; pp. 1, 5 (FIG. 3), 6 and 18, inter alia.

3M Company; Interam TM Inorganic Intumescent Materials, Mounting Applications; Aug. 2, 1976; pp. 2, 3.

Seiter et al; Ford Three-Way Catalyst and Feedback Fuel Control System; Feb. 27–Mar. 3, 1978; SAE paper 780203; pp. 1, 3 (FIG. 2).

*Primary Examiner*—David L. Lacey

[57] ABSTRACT

Spacers formed from mica are disposed in a catalytic converter between a monolithic ceramic catalyst element and a metal converter housing. As the converter warms, the spacers increase the compressive loading on the catalyst element to support and immobilize it within the housing.

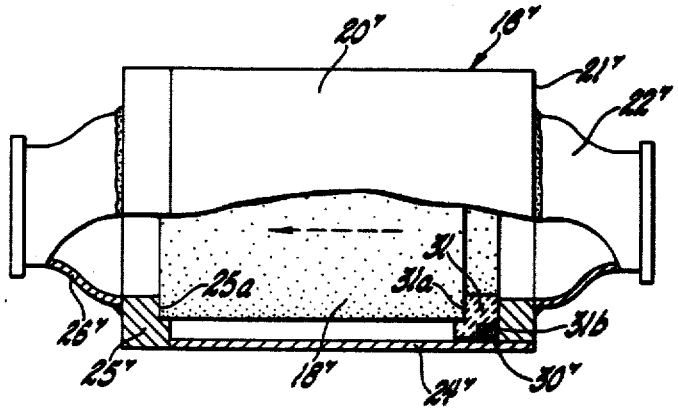

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-7 is confirmed.

* * * * *